US007640839B2

(12) United States Patent
McNulty, Jr.

(10) Patent No.: US 7,640,839 B2
(45) Date of Patent: Jan. 5, 2010

(54) METHOD AND APPARATUS FOR IMPROVING THE EFFECTIVENESS OF ELECTRICAL DISCHARGE WEAPONS

(76) Inventor: James F. McNulty, Jr., 1290 Third St., Calimesa, CA (US) 92320

( * ) Notice: Subject to any disclaimer, the term of this patent is extended or adjusted under 35 U.S.C. 154(b) by 668 days.

(21) Appl. No.: 11/073,507

(22) Filed: Mar. 7, 2005

(65) Prior Publication Data

US 2005/0262994 A1 Dec. 1, 2005

Related U.S. Application Data

(63) Continuation-in-part of application No. 10/719,131, filed on Nov. 21, 2003, now abandoned.

(51) Int. Cl.
*F41B 15/04* (2006.01)

(52) U.S. Cl. ..... 89/1.11; 89/1.34; 361/232

(58) Field of Classification Search ..... 89/1.11, 89/1.34; 361/232

See application file for complete search history.

(56) References Cited

U.S. PATENT DOCUMENTS 5,654,867 A 8/1997 Murray
5,786,546 A * 7/1998 Simson ..... 102/438
5,936,183 A * 8/1999 McNulty, Sr. ..... 89/1.11
6,575,073 B2 * 6/2003 McNulty et al. ..... 89/1.11
6,729,222 B2 * 5/2004 McNulty, Jr. ..... 89/1.34
7,075,770 B1 * 7/2006 Smith ..... 361/232
2002/0170418 A1 * 11/2002 McNulty, Jr. et al. ..... 89/1.11
2003/0010184 A1 * 1/2003 McNulty, Jr. ..... 89/1.34
2006/0187610 A1 * 8/2006 Su ..... 361/232

* cited by examiner

*Primary Examiner*—Troy Chambers
(74) *Attorney, Agent, or Firm*—Ishman Law Firm P.C.

(57) ABSTRACT

A cartridge for propelling a pair of wire-tethered contact darts for disabling a remote target with an electrical discharge. The cartridge comprises two bores each having one wire-tethered dart in front of an electrically activated pyrotechnic. A cartridge contains two separated straight bores, which each launch a single dart assemblage with a single primer of standard manufacture. A single 200 large rifle primer can launch a single dart assemblage reasonably accurately to 30 feet from the cartridge. Each assemblage is deflected to a predicted angle of flight when it collides with a center hinged cover as it exits the cartridge. This arrangement allows for longer flight distances and tighter, but still effective, dart spreads throughout the travel.

2 Claims, 6 Drawing Sheets

METHOD AND APPARATUS FOR IMPROVING THE EFFECTIVENESS OF ELECTRICAL DISCHARGE WEAPONS

CROSS-REFERENCE TO RELATED APPLICATIONS

The present application is a continuation-in-part of application Ser. No. 10/719,131 filed on Nov. 21, 2003 now abandoned.

BACKGROUND OF THE INVENTION

1. Field of the Invention

The present invention relates generally to the field of electrical discharge weapons and specifically to a method and apparatus for improving their effectiveness.

2. Background Art

Stun pistols are weapons that connect a shocking power supply to a remote human target. Peace officers routinely use stun pistols to incapacitate violent suspects when lethal force is not justified. Stun pistols have a lower lethality than conventional side arms.

A stun pistol fires a pair of electrically opposed darts toward a target. Each dart has a trailing conductor, which remains connected to an alternate pole of a shocking supply. When both of the paired darts contact the target, a shock is passed between the darts through the target.

Both darts and tethered conductors are contained within the single Y shaped bore of an ammunition cartridge prior to firing. A variation of such a cartridge is described in U.S. Pat. No. 5,654,867 to Murray (April, 1997). Looking at FIG. 12 therein, the dart assemblages 69, 67, 62 and 71, 77, 64 are each seated in the bore in front of a single metal cased propelling primer 78 at the bore exits along with a portion of their tethered conductor (not shown). Each conductor then feeds from the back of its dart assemblage and out through the bore to one of two wire storage chambers (not shown) in the cartridge and, then, alternatively, to either supply contact 83 or supply contact 78, which is also the propelling primer. Desirably, the lower or angle launched dart assembly 71, 77, 64 is connected to supply contact 83 to avoid arcing shorts between the alternate 69, 67, 62 assemblage and the 83 contact when attempting to pass a shock through a remote target.

When the stun pistol's power supply is energized, the sparking current passes through the tethered conductor from 83 to 64, arcs between 64 and 62, passes through the remaining tethered conductor from 62 to 82 and, then, sparks from 82 to 78 and ignites the detonating powder (typically a mixture comprising lead styphnate and glass frit, which aids percussion ignition) contained therein. The dart assemblages are propelled forward and the circuit opens until it again completes through a remote human target. A Berdan type 200 large rifle primer, with its anvil removed for electrical ignition, can launch both darts to a distance of up to 15 feet from the pistol without a projectile drop significant enough to effect aiming accuracy. The bore is not rifled to spin the darts, so with wire drag and gravitation forces, the flight of the darts follows a standard downward trajectory arc, which is mitigated by dart velocity, which, among other things, reduces the time of flight to the target as the dart will remain in flight only for the time it would take for the dart to drop most directly from the launcher horizontally to ground. Depending on the transformer orientation, the current might also follow a reverse path from 78 to 83 to ignite the propellant charge.

Stun pistol cartridges are small, compact, easily transportable rounds, which are suitable for loading into a small hand-held firearm. Depending upon the ammunition manufacturer, the nearest perimeter of each bore exit is between $\frac{1}{8}^{th}$ inch to $\frac{6}{8}^{th}$ inch distant from the other. However, when contacting a target, the darts must be at least 7 inches distant from each other for the stun pistol shocks to pass through enough musculature to incapacitate an assailant. Stun pistols incapacitate by rigidly fixating joints. Each shock causes the muscle in its path to contract. Stun pistol pulses are repeated at a rate where the muscle cannot fully return to a relaxed state between shocks. The muscle remains in a temporarily shortened or taunt state while the train of pulses passes through it. Thereby, joints may become fixated, and if enough of the musculoskeletal system is involved, the target is incapacitated. Accordingly, manufacturers angle one or both of the cartridge bores from horizontal, so the darts will become more distant from each other in flight from the bore exits to the target. Depending upon ammunition manufacturer, launching angles are between 7° and 11°. This means that the darts may not be sufficiently distant from each other to pass an incapacitating shock train during the first 3 feet to 4 feet of flight and are likely too distant to both land in a target to complete a shocking circuit after 15 feet of flight. The best effective stun pistol range is from 8 feet to 12 feet. Depending on the manufacturer, a stun pistol's high tension pulse train occurs at a frequency of 10 to 25 pulses per second and a power of between 2.5 and 25 watts.

It is quite risky for a peace officer, armed with a stun pistol, to be within 15 feet, even 21 feet, of a violent suspect. Should the officer miss the suspect when firing or the stun pistol fail to incapacitate the suspect for another reason, the suspect might easily reach and attempt to overpower the officer before he or she could draw their side arm or other weapon. In the ensuing scuffle, the officer might lose his or her side arm and be killed or injured with it.

Of course, there are additional obstacles to improving stun pistol range. As stated, the cartridge launches its darts by explosion of a primer without any other propellant charge in much the same way that the original Louis Flobert (1819-1894) rim fire cartridge, using only a modified percussion cap, launched its projectile or BB pellett. As stated, a single 200 large rifle primer will launch both cartridge darts reasonably accurately to 15 feet from a cartridge's Y bore. However, to launch both darts with reasonable accuracy to 21 feet from a cartridge's Y bore, the primer cup must have the full propellant charge from both a 200 large rifle primer and a 400 small rifle primer. To launch both darts with reasonable accuracy to 30 feet from a cartridges Y bore, the primer cup must have the full propellant charge from two 200 large rifle primers. Moreover, even when launched with propellant from both a 200 large rifle primer and a 400 small rifle primer, the darts may not have sufficient force to impale into a target that is 21 feet distant from the cartridge. While the muzzle velocity of the darts is about 200 feet/second, the impact velocity after a 21 foot flight is only about 50 feet/second.

As observed, primers are intended to detonate a propellant powder by convection or, in other words, flash ignition. Primer ignition is not normally, itself, intended to propel projectiles. The routine inconsistency of the mixture of detonating powder in the primers causes bullet velocity spreads of from 15 fps to 100 fps. While this variation is normally not problematic where bullets are also propelled by the primer detonated propellant powder to typical muzzle velocities of over 1000 fps, the variation is a problem when projectiles are propelled by the detonating charge alone.

Optimally, the primer gases envelop a propellant powder's grains with enough thermal energy, conductivity and depth, so the surfaces of the grains are kept above their kindling point from primer flash until each grain completely ignites. The energy available to flash ignite the propellant powder is the energy supplied by the discharging primer less the energy used to heat the other normally highly heat conductive components of the system, like the cartridge's metal case and bullet and the metal firearm receiver. The gases enveloping the powder grains are typically heating to 5300° F.

Of course, if the detonating charge in the primer is increased, heating within a cartridge case will increase. Such increases are problematic for stun pistol cartridges. As the primer flash enlarges, it can even melt wiring that is distant from the primer within the cartridge. The wire tethered at the dart assembly is 36 AWG copperweld insulated with a 0.005 to 0.075 wall of Tefzel. The melt point of copper is just 1981° F. If the wire melts away and detaches from the assemblage, the dart will launch to a remote human target without its tethered conductor, and the shocking circuit will, of course, not complete through the target. This is a minor risk even when the stun pistol darts are launched by a single 200 large rifle primer, which contains its standard charge of detonating powder. Some manufacturer's primers burn "hotter" than others. In ascending order of "hotness" are Remington, CCI/Speer and Winchester primers. CCI/Speer primers are typically specified for stun pistol ammunition. Using, even, CCI/Speer 200 "magnum" rifle primers, which burn hotter than the standard 200 primer, results in a statistically significant number of wire tethers melting, as certainly does adding propellant from a 400 small rifle primer or doubling the charge in a 200 large rifle primer. Doubling the charge will also melt portions of the necessarily insulative plastic cartridge cases, which are shot from high impact D305 ABS plastic.

SUMMARY OF THE INVENTION

The inventive cartridge overcomes these prior art problems to improve stun pistol range and accuracy. A cartridge contains two separated straight bores, which each launch a single dart assemblage with a single primer of standard manufacture. A single 200 large rifle primer can launch a single dart assemblage reasonably accurately to 30 feet from the cartridge. Each assemblage is deflected to a predicted angle of flight when it collides with a center hinged cover as it exits the cartridge. This arrangement allows for longer flight distances and tighter, but still effective, dart spreads throughout the travel.

BRIEF DESCRIPTION OF THE DRAWINGS

The aforementioned objects and advantages of the present invention as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
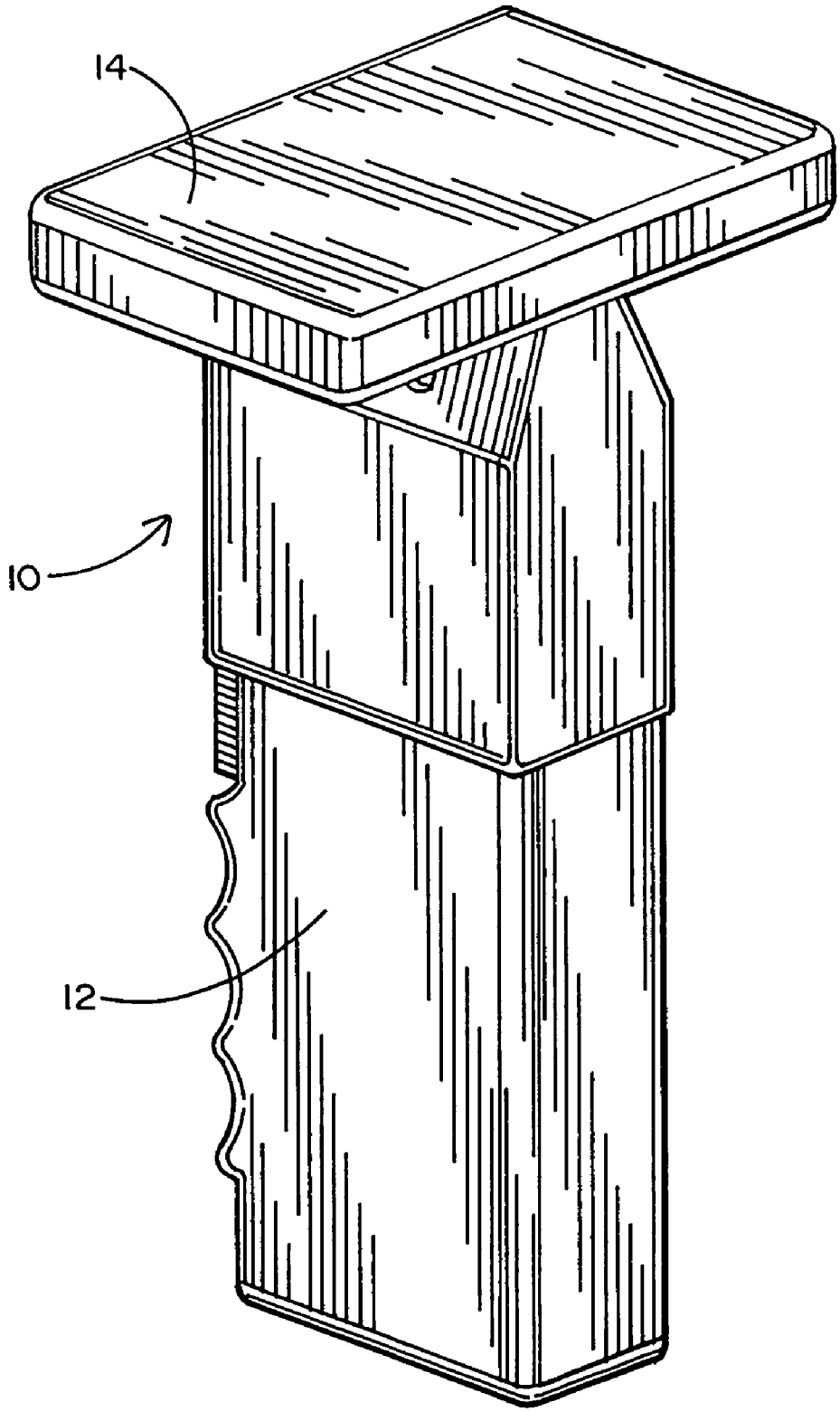
FIG. 1 is a three-dimensional view of an embodiment of the present invention comprising a hand-held stun gun that has been combined with a cartridge containing a pair of wire-tethered darts for disabling a remote target.
Figure 2:
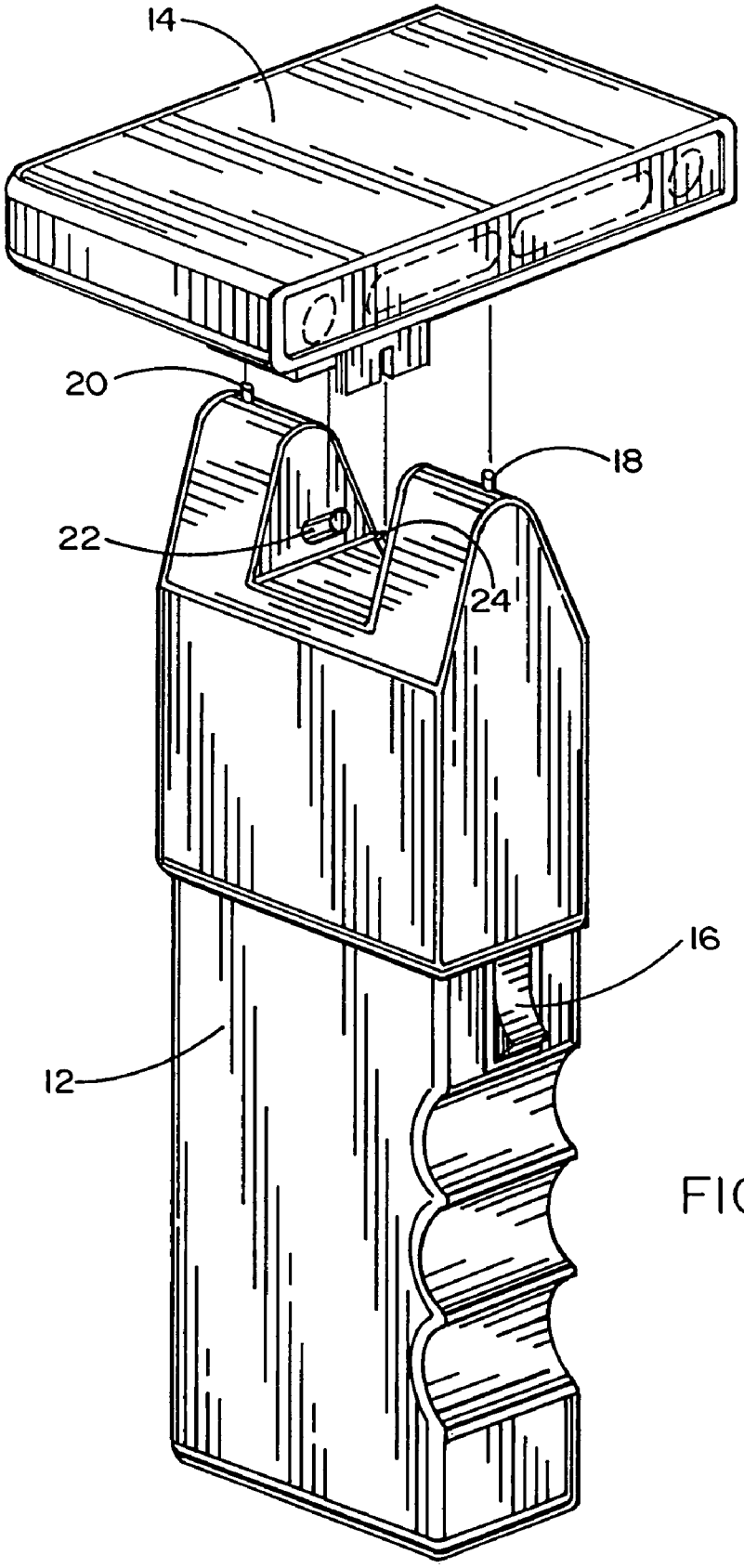
FIG. 2 is an exploded view of the embodiment of FIG. 1.
Figure 3:
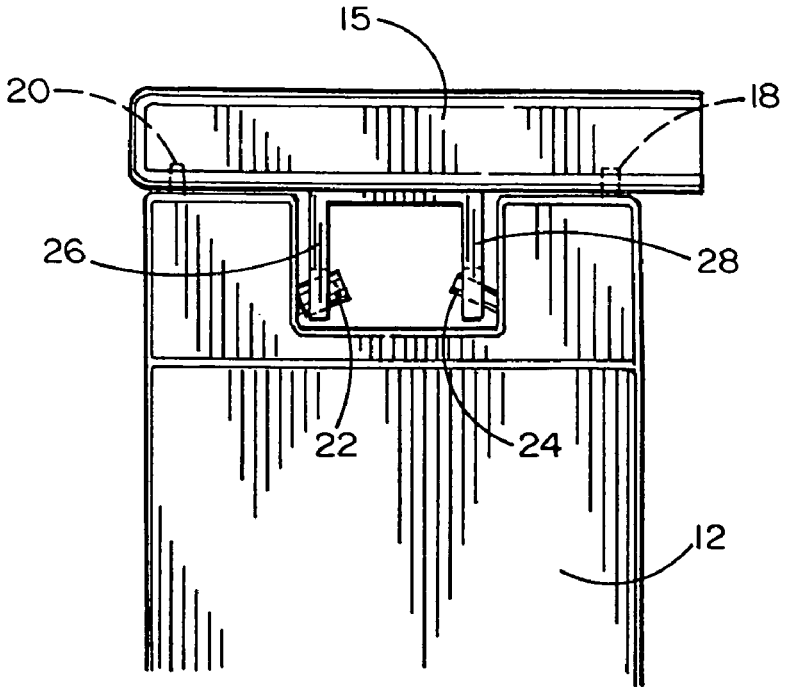
FIG. 3 is a partial side view of the embodiment of FIG. 1.
Figure 4:
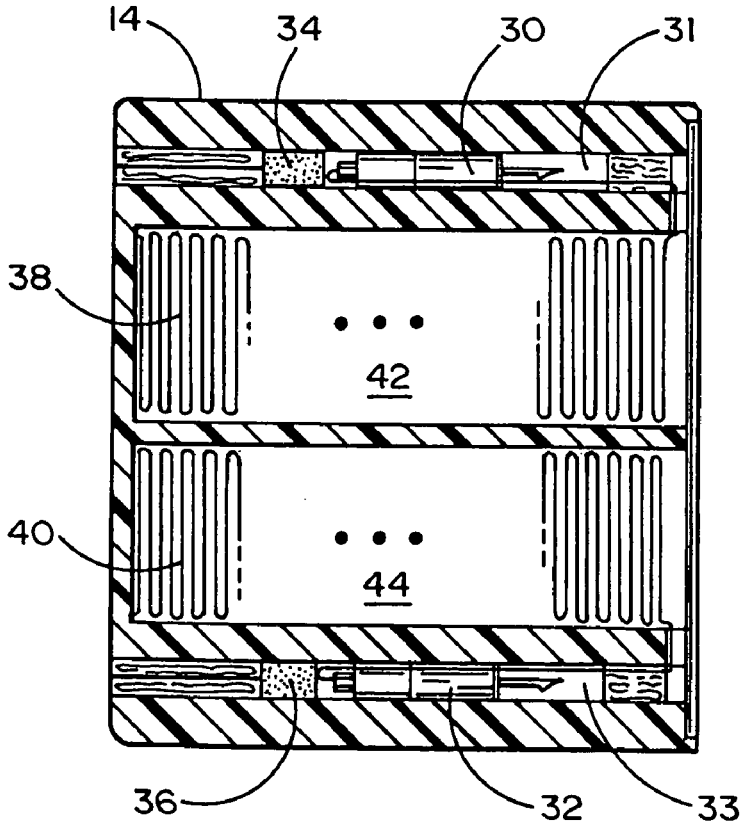
FIG. 4 is a cross-sectional view of the cartridge of FIG. 1.
Figure 5:
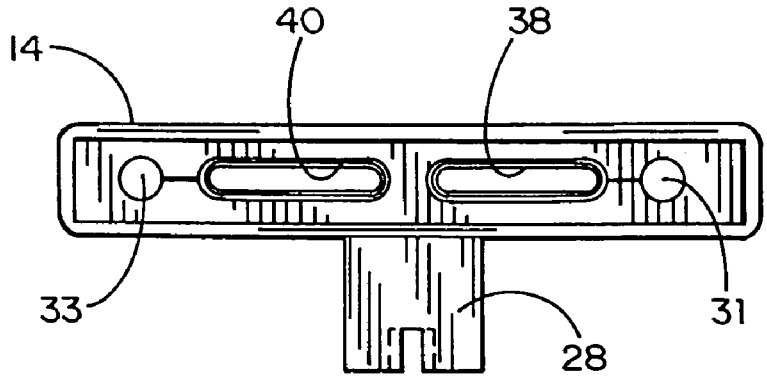
FIG. 5 is a front view of the cartridge of FIG. 1.

Referring to the accompanying drawings and initially FIGS. 1 to 5, it will be seen that a combined stun gun and cartridge 10 comprises a stun gun 12 and a cartridge 14, the latter being releasibly attached to the former to add a remote target immobilization capability to the near target capability of the stun gun. The stun gun 12 comprises an activation switch 16, proximity contacts 18 and 20 and arcing contacts 22 and 24. Arcing contact 22 is preferably larger in diameter than arcing contact 24 so that cartridge 14 cannot be connected to stun gun 12 while facing in the wrong direction which could otherwise cause injury to the user.

Cartridge 14 comprises a flat rectangular housing 15 having a pair of connectors 26 and 28 designed to mate mechanically with contacts 22 and 24 of stun gun 12 and electrically with contacts 18 and 20 of stun gun 12. Darts 30 and 32 reside in respective cylindrical bores 31 and 33 ready to be propelled toward a remote target by respective pyrotechnics 34 and 36 which sit immediately behind the darts within the bores. Each dart 30, 32 is tethered by a long thin insulated wire 38, 40 which respectively resides in chambers 42, 44 of housing 15. When switch 16 of stun gun 12 is depressed, high voltage is applied to pyrotechnics 34 and 36 through connectors 18 and 20 and ignites the pyrotechnics to release expanding gas to propel wire-tethered darts 30 and 32 toward a remote target out of bores 31 and 33. The voltage is then applied through wires 38 and 40 to the darts which apply the voltage across impact locations on the remote target.

Figure 6:
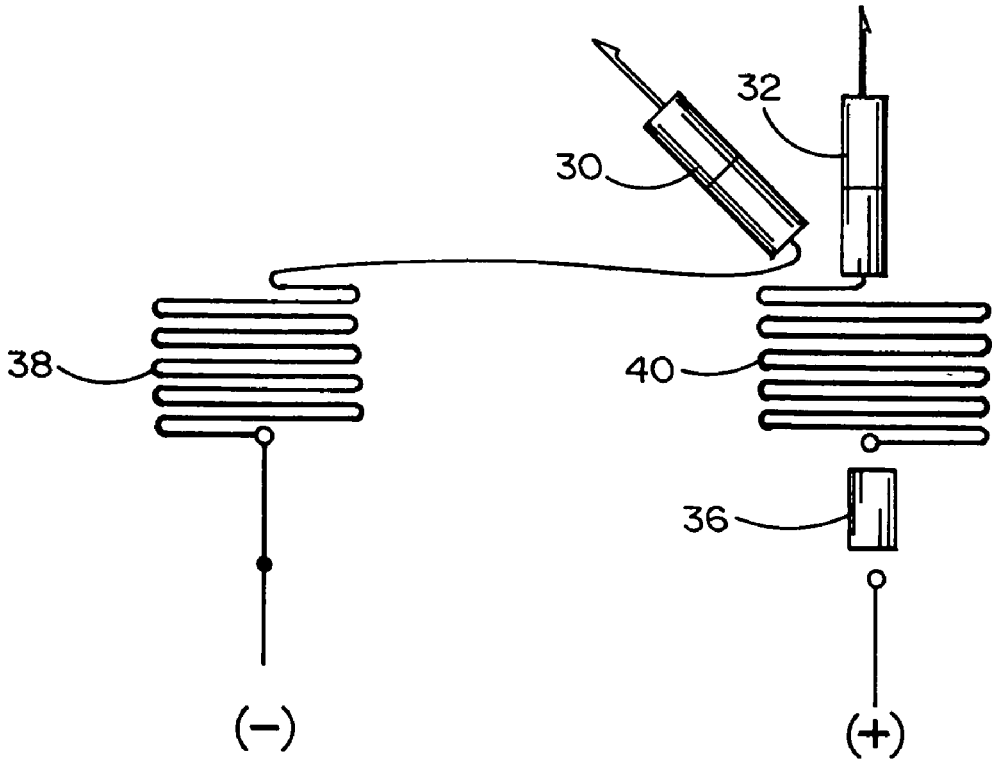
FIG. 6 (PRIOR ART)
FIG. 6 is a schematic illustration of a prior art electrical layout of a two-dart cartridge.

FIG. 6 illustrates conventional prior art layout of electrical interface between high voltage poles (+) and (−), pyrotechnics and wire tethered darts. Upon application of the high voltage (depression of switch 16), pyrotechnic 36 ignites and a current arcs across remaining gaps to the respective wires 38 and 40 and darts 30 and 32 (which will have already exited their respective bores). This reliance on arcing across gaps left by pyrotechnic 36 causes the aforementioned disadvantages.

Figure 7:
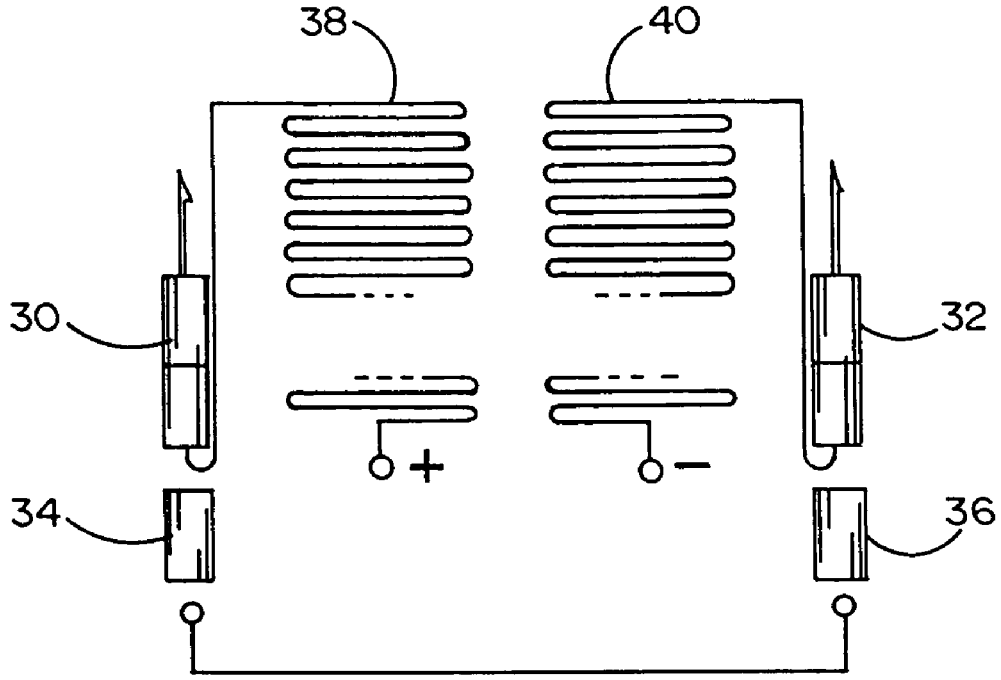
FIG. 7 is a schematic illustration of a first embodiment of an improved electrical layout for increasing effectiveness of a two-dart cartridge.
Figure 8:
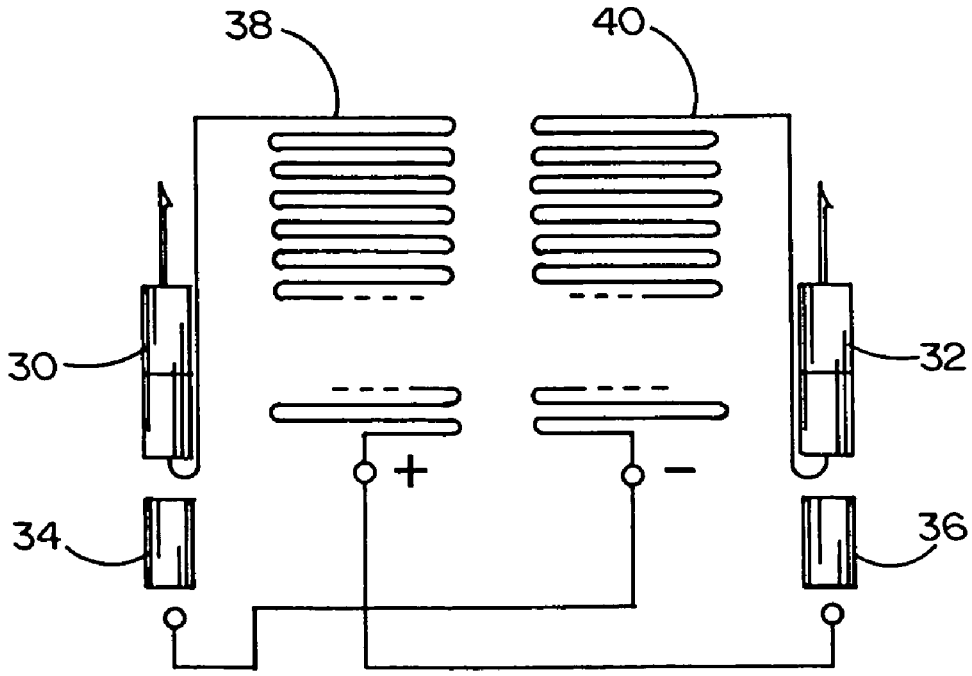
FIG. 8 is a schematic illustration of a second embodiment of an improved electrical layout for increasing effectiveness of a two-dart cartridge.

The schematic circuits of FIGS. 7 and 8 illustrate two alternatives to the prior art layout of FIG. 6 which avoid the gap arcing problem. In the layouts of FIGS. 7 and 8, the wiring of the pyrotechnics is designed to ignite them and then cease current flow through them so that there is no reliance on arcing over the gap left by the pyrotechnics in order to deliver current through the darts and the target. The circuit of FIG. 7 effectively connects the pyrotechnics in series with one another, but in parallel with the darts and the target. The circuit of FIG. 8 effectively connects each of the pyrotechnics separately in parallel with the darts and the target. Nevertheless, the pyrotechnics remain physically adjacent their respective darts to effect propulsion of the darts upon their ignition.

Figure 9:
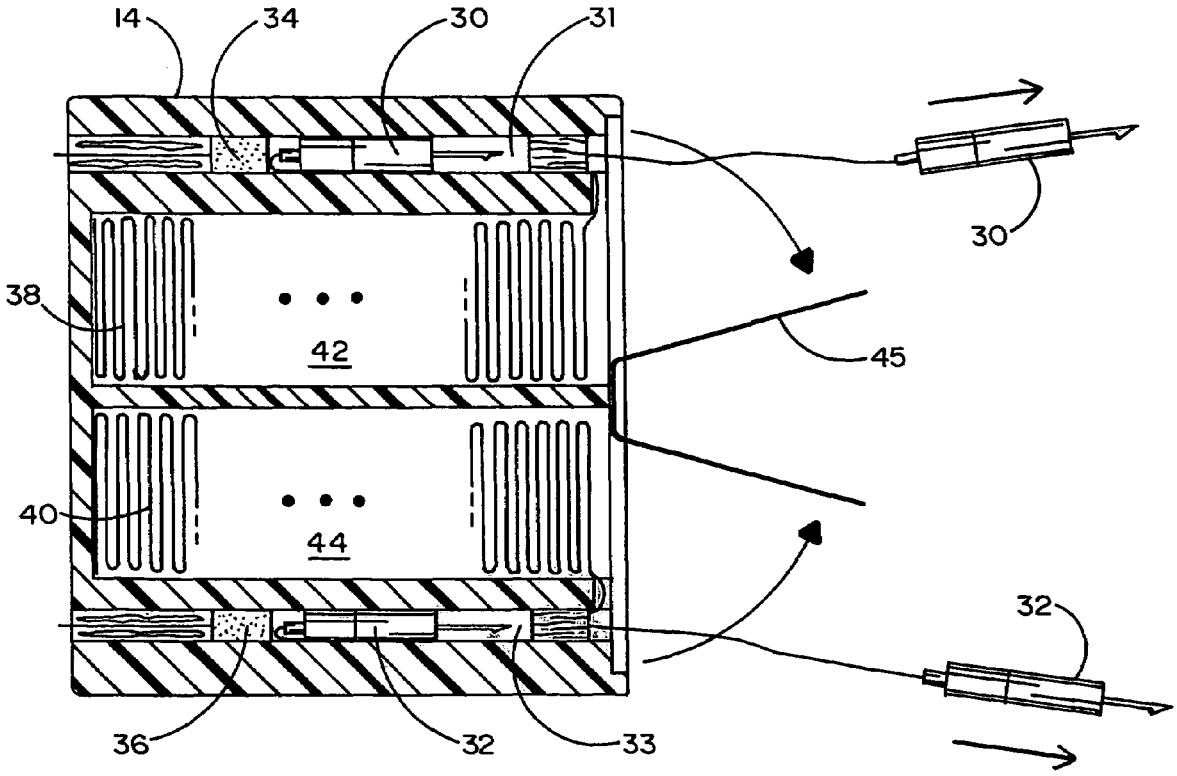
FIG. 9 is a view similar to FIG. 4 but showing a center hinged cover for deflecting the darts to separate in flight.
Figure 10:
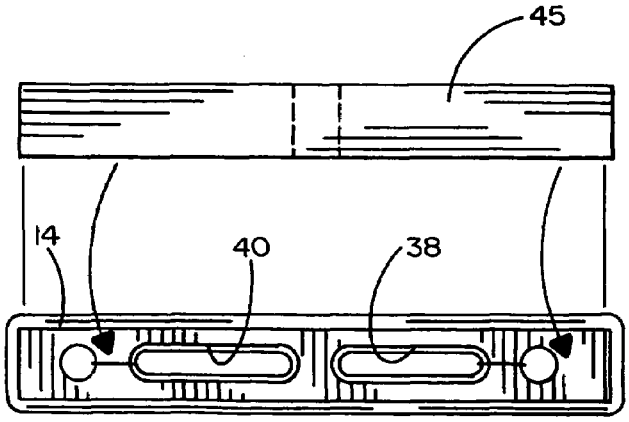
FIG. 10 is a view similar to FIG. 5 but showing the hinged cover of FIG. 9.

Referring to FIGS. 9 and 10, it will be seen that 6 mm bores are positioned without angling them at (0°) about three (3) inches apart on parallel sides of an ammunition cartridge, that is about the size and shape of a 3½ inch computer floppy disk, but thicker. A cartridge of this size can still be conveniently transported and loaded into a hand gun. Each dart assemblage and a portion of its tethered conductor is fed into a different bore in front of a single CCI/Speer 200 rifle primer. The face of the cartridge containing the muzzles is covered by an adhering surface that both covers the muzzles and extends between a projection of the muzzles along the face of the cartridge and that can bend at this extending surface. The cover might be fashioned of a lightly adhering tape like the Easy Mask® Painting Tape manufactured by Loparex, Inc. of Willowbrook, Ill. or from a length of cardboard or plastic, adhered heavily to the cartridge face between the muzzle projections and lightly tacked with adhesive to the cartridge face at each end of the cover length's axis which extends through both muzzle projections. Now, when the primer ignites, the explosive force and/or each dart assemblage collides with an opposite end of the cover, causing each end of the cover to detach from the cartridge face and to travel toward each other in an arc while the midsection of the cover remains, at least momentarily, adhered to the cartridge face. Each dart is deflected to a predicted angle from the collision or later collision.

These inventive cartridge, with cover fashioned of Easy Mask® Painting Tape, have been manufactured and sold by Tu Corporation of Calimesa, Calif. since Apr. 16, 2004. During the entire history of manufacture, not one dart is reported to have exited a cartridge while detached by melting from its trailing conductor. Moreover, the cartridge's paired darts are generally spread about 7 inches distant from each other when impacting a target that is four (4) feet distant from the stun pistol, one foot distant from each other when impacting a target that is 15 feet distant from the stun pistol and spread about two (2) feet from each other when 30 feet distant from the target. These tight firing patters allow the cartridges darts to both impact into the average person's trunk over the entire improved range of the stun pistol. Moreover, spreads are still near as wide for close range impacts as with prior art stun pistols as the darts leave the cartridge already three (3) inches distant from each other.

Having thus disclosed a number of illustrative embodiments of the invention herein, it will now by apparent that the illustrated electrical layouts avoid the disadvantages of the prior art. Moreover, it will be understood that variations from the disclosed embodiments may be readily perceived based upon the teaching herein. Accordingly, the scope hereof is to be limited only by the appended claims and their equivalents.

I claim:

1. A cartridge for use in a stun gun, the cartridge having a pair of wire-tethered contact darts adjacent respective electrically activated pyrotechnics for propelling the darts toward a remote target for disabling the target; the cartridge comprising:

a pair of elongated bores that are space apart from one another, one of said contact darts positioned in each of said bores, said elongated bores being substantially; parallel to one another; and a hinged cover affixed to an exterior surface of said cartridge between said bores, unaffixed portions of said cover extending over said bores for being deflected therefrom by said contact darts upon their exiting from said bores.

2. The cartridge as recited in claim 1 wherein said exiting darts are deflected apart by said unaffixed portions of said cover.

* * * * *